US005370051A

United States Patent [19]

Schild et al.

[11] Patent Number: 5,370,051

[45] Date of Patent: Dec. 6, 1994

[54] CLAMPING DEVICE FOR ATTACHING PRINTING PLATES IN PROPER REGISTRY ON THE PLATE CYLINDER OF PRINTING MACHINES

[75] Inventors: Helmut Schild, Steinbach; Gerhard Augsberg, Seligenstadt; Nikola Pupic, Heusenstamm; Armin Schafer, Offenbach, all of Germany

[73] Assignee: MAN Roland Druckmaschinen AG, Germany

[21] Appl. No.: 147,159

[22] Filed: Nov. 3, 1993

[30] Foreign Application Priority Data

Nov. 5, 1992 [DE] Germany ..... 9215069[U]

[51] Int. Cl.[5] ..... B41F 21/00

[52] U.S. Cl. ..... 101/415.1; 101/383; 101/DIG. 36

[58] Field of Search ..... 101/378, 382.1, 383, 101/384, 385, 386, 387, 388, 389, 415.1, 486, 487, DIG. 36; 33/614, 617, 618, 620, 621

[56] References Cited

U.S. PATENT DOCUMENTS

| | | | |
|---|---|---|---|
| 2,621,592 | 12/1952 | Faeber | 101/415.1 |
| 3,835,778 | 9/1974 | Bock | 101/415.1 |
| 3,882,775 | 5/1975 | Lytle et al. | 101/415.1 X |
| 3,899,972 | 8/1975 | Albright | 101/378 X |
| 4,437,407 | 3/1984 | Wirz et al. | 101/409 |
| 4,557,196 | 12/1985 | Köbler | 101/415.1 |
| 4,748,911 | 6/1988 | Kobler | 101/378 |
| 5,016,531 | 5/1991 | Schroeder | 101/415.1 |

FOREIGN PATENT DOCUMENTS

| | | | |
|---|---|---|---|
| 0075900B1 | 1/1985 | European Pat. Off. . | |
| 3000576 | 7/1981 | Germany | 101/415.1 |
| 3940796C2 | 9/1991 | Germany . | |
| 4129831A1 | 7/1992 | Germany . | |
| 0063165 | 4/1985 | Japan | 101/415.1 |
| 62-221541 | 9/1987 | Japan . | |

*Primary Examiner*—Edgar S. Burr
*Assistant Examiner*—Christopher A. Bennett
*Attorney, Agent, or Firm*—Leydig, Voit & Mayer, Ltd.

[57] ABSTRACT

A clamping device for attachment of a printing plate having registry defining notches in the leading edge thereof in proper registry on the plate cylinder of a sheet-fed printing machine is provided. The clamping device includes a clamping rail disposed in an axis-parallel recess in the plate cylinder and has a closable plate receiving gap therein for fastening the leading edge of the printing plate to the clamping rail. A plurality of adjustable stops are disposed in the plate receiving gap of the clamping rail for abutting the corresponding registry defining notches in the leading edge of the printing plate for locating the printing plate on the cylinder in proper registry.

7 Claims, 2 Drawing Sheets

CLAMPING DEVICE FOR ATTACHING PRINTING PLATES IN PROPER REGISTRY ON THE PLATE CYLINDER OF PRINTING MACHINES

FIELD OF THE INVENTION

The present invention relates to a device for attaching printing plates on the plate cylinder of sheet-fed printing machines in proper registry.

BACKGROUND OF THE INVENTION

In sheet-fed offset printing machines, the printing plates for the part images of different colors are each mounted on a separate plate cylinder. Each printing plate is fastened or clamped, with the leading edge corresponding to the print start, in a clamping rail and is then laid around the outer circumference of the cylinder, until the trailing edge corresponding to the print end can be fastened, in turn, in a second clamping rail. The proper tension is thereafter applied to the printing plate.

To reduce spoilage, the images of the first full color prints should already have a high accuracy of fit after the respective printing plates for the individual colors have been clamped on. The leading edges of individual printing plates must therefore be introduced very carefully into the associated print-start clamping rail, that is to say accurately with respect to proper registry. For this purpose, the printing plates often have, at their leading edge a plurality of spaced-apart registry defining notches or recesses in the form of, for example, U-shaped punched-out portions which cooperate with stops arranged in the region of the plate receiving gap of the clamping rails. These stops ensure that the printing plate, when introduced into the opened receiving gap, is aligned in register via the punched-out portions. Conventional stops of this kind are known in the prior art as so-called locating pins.

A clamping rail with locating pins of the type briefly outlined above is known, for example, from EP-0,075,900 B1. This clamping rail is mounted movably in the axis-parallel recess of the plate cylinder and, for the in-register alignment of the printing plate, can be adjusted relative to the plate cylinder via additional tension screws. The alignment of the locating pins or stops and therefore also of the print start of the printing plate takes place via an adjustment of the clamping rail carrying the locating pins. A register system of this kind can be used advantageously in printing machines in which the printing plate changeover and the subsequent attachment of a newly drawn-on printing plate are carried out manually by an attendant.

In printing machines having a device for the semi-automatic or fully automatic changeover of printing plates (JP-A 62-221 541, DE 3,940,796 C2), however, the printing plate is to be attached in registry already as a result of the introduction of its front edge into the opened plate receiving gap of the clamping rail. There is no need therefore for any manual adjustments in the region of the plate cylinder, in order to align the printing plate in register on the plate cylinder. Printing machines of this type are therefore expediently equipped with a clamping rail mounted fixedly relative to the cylinder, so that the locating pins or stops attached to the clamping rail produce a register system fixed relative to the cylinder (DE 4,129,831 A1).

However, a disadvantage of a register system fixed relative to the cylinder and already known from the prior art publication last mentioned is that the clamping rail equipped with devices for motive or remotely actuable clamping is very bulky and consequently, when being mounted within the recess of the plate cylinder, involves a high outlay in terms of its adjustment into the exact desired position for the locating pins. Such an outlay in the adjustment of the clamping rail occurs not only when the later is being mounted at the factory, but, in particular, also after repairs on the clamping mechanism of the rail. A correction of the position of the locating pins which may be necessary, for example when a new printing plate punch is purchased or an existing printing plate punch is equipped with a new punching die, likewise incurs a high changeover expense. Moreover, with locating pins fixedly mounted in the clamping rail, adaptation to punched-out portions of a different type on the printing plates is possible only at a high outlay for the appropriately modified clamping rail,

OBJECTS AND SUMMARY OF THE INVENTION

The primary object of the present invention is, therefore, to provide a clamping device in the plate cylinder of a sheet-fed printing machine for receiving the leading edge of a printing plate wherein a simplified adjustment of the stops or locating pins responsible for the in-register attachment of the printing plate is possible.

According to the invention, movable stops are provided within the plate receiving gap of the clamping rail and cooperate with the punched-out registry defining notches in the printing plate leading edge. The stops are mounted so as to be adjustable relative to the clamping rail within the plate receiving gap and particularly in the circumferential direction of the plate cylinder. The stops according to the invention are either adjustably mounted locating pins or an adjustably mounted slide which, on its end directed towards the printing plate leading edge, has a contour corresponding to one of the registry defining notches.

According to the invention, adjustability of the stops in at least the circumferential direction of the plate cylinder is provided. It is also advantageous, however, that adjustability in the axial spacing or side register of at least one stop can also be provided. If the stops are fastened to the clamping rail not only adjustably, but also releasably, then, if a set of stops of different shapes is available, very simple adaptability to different register systems according to the shape and dimensioning of the punched-out portions on the leading edge of the printing plate is easily obtained. The adjustably mounted stops provided according to the invention can also be attached so as to be insulated relative to the clamping rail or to the plate cylinder and thus allow an electrical sensing of the bearing of the printing plate against the stops.

It may be mentioned, at this juncture, that the present invention does not relate to checking means which are attached to the cylinder and which cooperate with locating recesses in the form of orifices or locating holes (EP 0,295,848 B1).

The features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Turning now to the drawings, an enlarged, fragmentary portion of the plate cylinder 1 of a sheet-fed printing press is shown. It will be understood that a printing plate 5 (shown in FIG. 2) is secured to the plate cylinder such that the beginning of the image to be printed is properly positioned in registry with a print start line, indicated as DA in FIG. 1. As is typical, the plate cylinder 1 is formed with an axis-parallel recess or gap 2 in its outer periphery within which are located the clamping mechanisms for securing the leading and trailing ends of the printing plate 5 to the cylinder 1.

Figure 1:
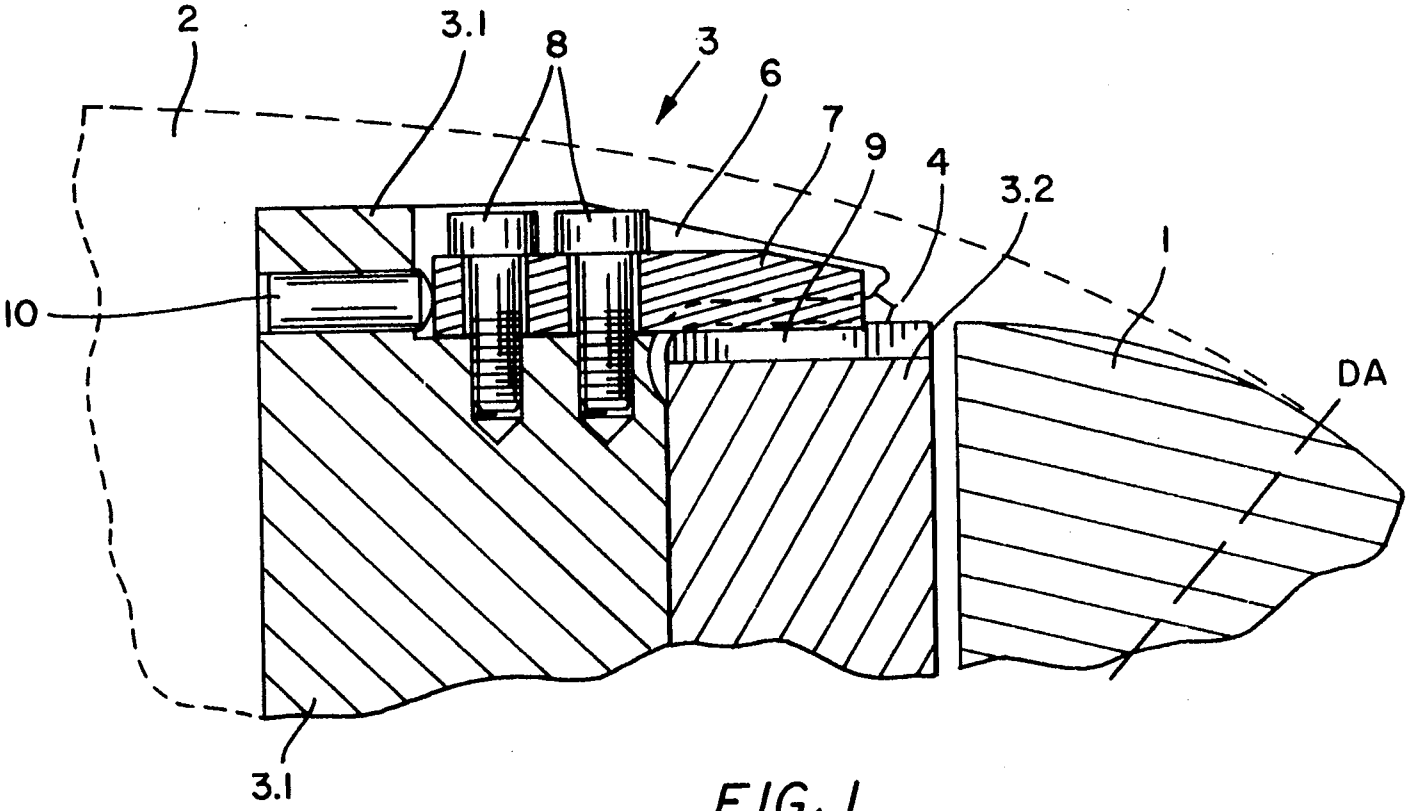
FIG. 1 is an enlarged, fragmentary cross section through a plate cylinder with a clamping rail having an adjustable stop according to the invention.

As shown in FIG. 1 only the clamping means, in the form of a clamping rail 3, for the leading edge of the printing plate is shown. In this exemplary embodiment, the clamping rail 3 consists of an upper clamping rail 3.1 mounted fixedly on the bottom of the recess 2 and of a lower clamping rail 3.2 arranged movably relative to the said upper clamping rail. The lower clamping rail 3.2 can be moved radially relative to the upper clamping rail 3.1 via a lifting mechanism not shown here and known, for example, from the state of the art.

If the lower clamping rail 3.2 is displaced downwards in FIG. 1, a plate receiving gap 4 is opened for introducing the leading edge of the printing plate 5.

If the lower clamping rail 3.2 is urged with force against the upper clamping rail 3.1, that is to say the plate receiving gap 4 is closed, the introduced leading edge of the printing plate 5 is clamped to the cylinder 1.

Figure 2:
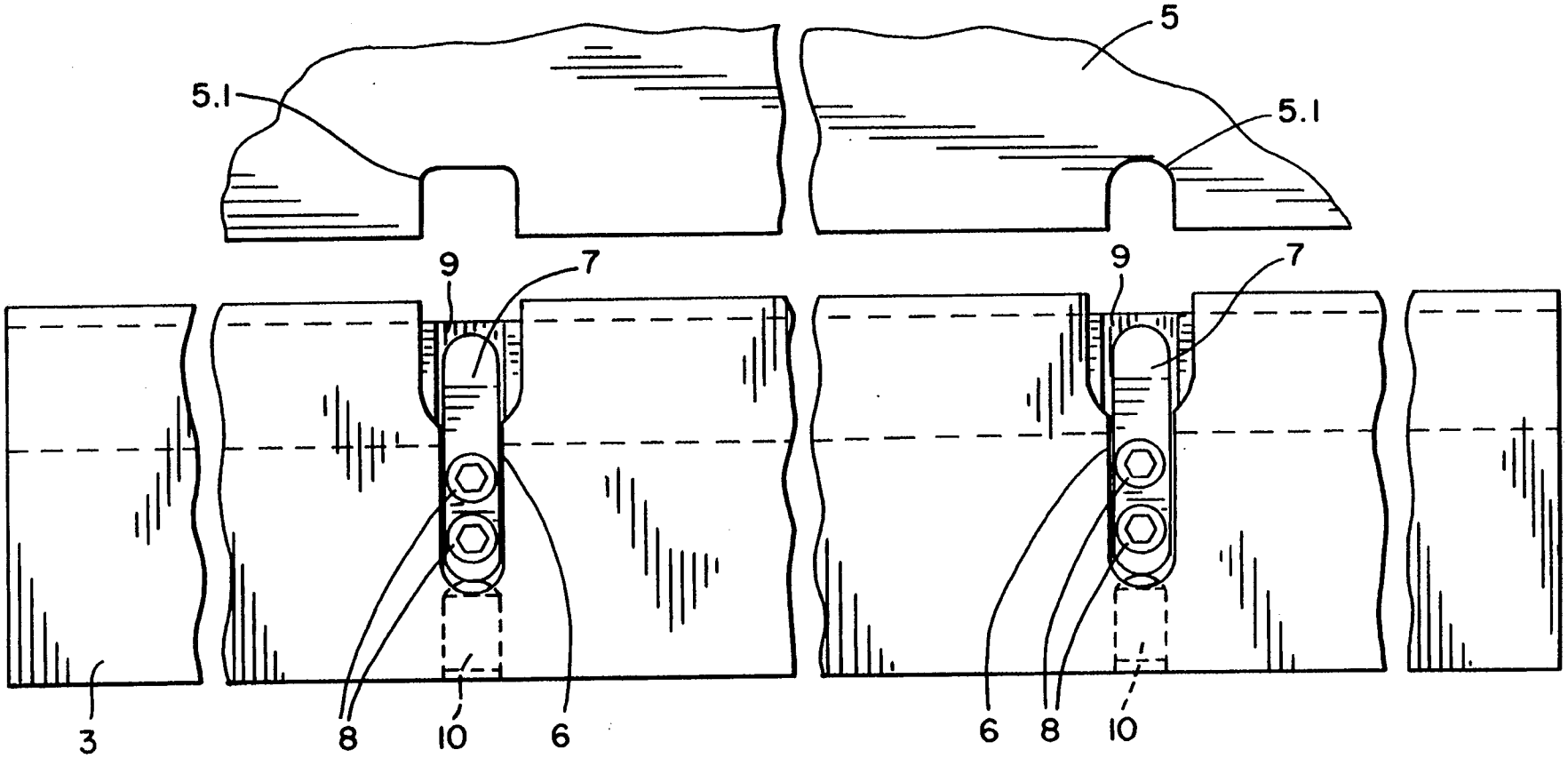
FIG. 2 is a fragmentary top view of the clamping rail shown in FIG. 1 having the adjustable stops recessed in it.

FIG. 2 shows a top view of the clamping rail 3 or the upper clamping rail 3.1 according to FIG. 1. The leading edge region of the printing plate 5 corresponding to the print start DA (FIG. 1) is shown above the clamping rail 3. The printing plate 5 has, in its leading edge, two punched-out registry defining portions or notches 5.1 shaped in the form of a U.

According to FIG. 2, two groove-shaped recesses or clearances 6 are cut into the upper clamping rail 3.1 As can be seen in FIG. 2, the clearances 6 are additionally widened in the part of the upper clamping rail 3.1 projecting over the lower clamping rail 3.2. The bottom of this groove-shaped clearance 6 is lower than the upper face of the lower clamping rail 3.2 when the lower clamping rail 3.2 is lowered to the maximum extent or when the plate receiving gap 4 is fully opened.

In accordance with the invention, a movable stop, in the form of a slide bar 7 is inserted into each of the two groove-shaped clearances 6 of the upper clamping rail 3.1. The end of each of the stops 7 facing the leading edge of the printing plate 5 is matched to one of the corresponding punched-out portions 5.1 in the printing plate 5 according to the register system provided, in such a way that the best possible in-register attachment of the printing plate is obtained.

As shown in FIGS. 1 and 2, each stop 7 is fastened to the upper clamping rail 3.1 in the respective clearance 6 via two fastening screws 8. For this purpose, the stops 7 have two respective passage bores, the diameter of which is calculated in such a way that sufficient movability is obtained relative to the shanks of the fastening screws 8 (for example hexagon-socket screws), so that the stops 7 too can be adjusted relative to the print start DA. The opposite sidewalls of the clearance 6 advantageously have such a fit relative to the corresponding flanks of the stop 7 that, with the fastening screws 8 released, the respective stop 7 can be moved in a virtually tilt-free manner in the direction of the print start DA or in the opposite direction.

In this exemplary embodiment, the rounded end of the respective stop 7 facing the printing plate 5 functions as a locating pin which cooperates with the printing plate 5 by means of a respective punched-out portion 5.1.

Since the underside of the stops 7 rests on the bottom of the clearance 6 and, as provided, the latter is somewhat lower than the upper side of the lower clamping rail 3.2 in the fully opened position, the lower clamping rail 3.2 is formed, in the region of each of the stops 7, with a groove 9 which makes it possible to close the plate receiving gap 4.

According to the invention, a plurality of stops 7 of varying length (relative to the distance between the foremost bore and the end of the stop 7) are provided having variously shaped ends cooperating with variously shaped punched-out portions or registry defining notches 5.1 in printing plates 5.

In an especially preferred embodiment of the invention, the stop 7 is provided with an adjusting means, whereby an accurate displacement (with the fastening screws 8 released) within the groove-shaped clearance 6 is obtained. As shown in FIG. 1, the adjusting means can be a threaded bolt 10 or cap screw which is screwed in a threaded bore and which can be actuated from the recess 2, for example by means of a tool, and acts on the end of the stop 7 facing away from the printing plate 5. In addition, spring means, not shown, can be provided for urging the stop 7 against the threaded bolt 10. However, a spring means of this type is unnecessary if the corresponding adjustment work on the stops 7 is carried out with the plate cylinder in a position which also corresponds approximately to that in which a printing plate 5 is introduced into the opened plate receiving gap 4. In general, the plate cylinder 1 is then in an angular position in which the plate receiving gap 4 points upwards and the stops 7 thus bear as a result of their own weight against the threaded bolt 10, with the fastening screws 8 released.

We claim as our invention:

1. A clamping device for attachment of a printing plate having registry defining notches in the leading edge thereof in proper registry on plate cylinder of a sheet-fed printing machine wherein said plate cylinder has an axis-parallel recess in the periphery thereof, said clamping device comprising, in combination, clamping rail means disposed in said cylinder recess and having a closable plate receiving gap therein for fastening the leading edge of said printing plate to said clamping rail means, movable stop means disposed in said plate receiving gap of said clamping rail means for abutting said corresponding registry defining notches in the leading edge of said printing plate, said stop means including a plurality of longitudinally spaced apart slide bars each having an abutting end facing the leading edge of said printing plate and said abutting ends being shaped to conform with said corresponding registry defining notches, and adjusting means for moving said stop means relative to said clamping rail means in the circumferential direction of the plate cylinder and lying in the plane of said plate receiving gap for locating said printing plate on said cylinder in proper registry.

2. A clamping device as defined in claim 1 including a plurality of fastening screws, and wherein said slide bars are respectively secured to said clamping rail means by said fastening screws which may be loosened to permit adjustment of said stop means.

3. A clamping device as defined in claim 1 wherein said adjusting means for each of said movable stop means includes a threaded bolt screwed into said clamping rail means for moving said stop means.

4. A clamping device as defined in claim 1 wherein said clamping rail means includes a plurality of groove-shaped recesses and wherein each of said slide bars is disposed in a respective one of said groove-shaped recesses.

5. A clamping device as defined in claim 3 wherein said clamping rail means includes a plurality of groove-shaped recesses and wherein each of said slide bars is disposed in a respective one of said groove-shaped recesses.

6. A clamping device as defined in claim 4 wherein said slide bars are formed with differently shaped abutting ends in conformity with the shape of said corresponding registry defining notches in the leading edge of said printing plate.

7. A clamping device as defined in claim 1 wherein said slide bars are formed with differently shaped abutting ends in conformity with the shape of said corresponding registry defining notches in the leading edge of said printing plate.

* * * * *